US005692243A

United States Patent [19]

Chang

[11] Patent Number: 5,692,243

[45] Date of Patent: Dec. 2, 1997

[54] HAIR BAND

[76] Inventor: Wen Shyong Chang, No. 7, Alley 116, Lane 175, Sec. 1, Ta Tung Rd., Tainan City, Taiwan

[21] Appl. No.: 642,894

[22] Filed: May 6, 1996

[51] Int. Cl.[6] ..... A45D 8/00

[52] U.S. Cl. ..... 2/171; 2/DIG. 11; 132/273

[58] Field of Search ..... 2/171, DIG. 11; 132/273; D28/39, 41

[56] References Cited

U.S. PATENT DOCUMENTS 5,449,008 9/1995 Yeh ..... 132/273

*Primary Examiner*—Diana Biefeld

*Attorney, Agent, or Firm*—Charles E. Baxley

[57] ABSTRACT

A hair band includes a body integrally formed of flexible material and has a first curvature and two engaging end portions each having an engaging slot defined therein and a retaining piece releasably attached to each engaging end portion. Each retaining piece is of a second curvature and includes a resilient snapping member formed on one end thereof for being releasably received in the engaging slot of the body.

1 Claim, 3 Drawing Sheets

HAIR BAND

BACKGROUND OF THE INVENTION

1. Field of the Invention

The present invention relates to a hair band and, more particularly, to a hair band allowing a user to change a body part thereof, thereby providing different ornamental effects.

2. Description of the Related Art

Hair bands are a familiar, popular article to women, especially young women. In addition to a hair retaining function, users of the hair bands also consider ornamental effects, for example, when selecting clothing and hair style of the user into consideration. Thus, the user generally buys many hair bands of different patterns to accommodate such selections. However, existing hair bands are integrally formed and colors thereof are not changeable and, after a long term usage, may fade and wear and thus diminish their ornamental function. Accordingly, conventional hair bands do not have high utility and cause unnecessary expense to users.

Therefore, there has been a long and unfulfilled need for an improved hair band to mitigate and/or obviate the foregoing problems.

SUMMARY OF THE INVENTION

It is an object of the present invention to provide a hair band which includes a body and two retaining pieces releasably attached to the body, thereby allowing the user to choose the body of a required pattern.

A hair band in accordance with the present invention generally includes a body integrally formed of flexible material and having a first curvature and two engaging end portions each having an engaging slot defined therein and a retaining piece releasably attached to each of the engaging end portion. Each retaining piece is of a second curvature and includes a resilient snapping member formed on one end thereof for being releasably received in its respective engaging slot of the body.

Preferably, each engaging end portion of the body includes an engaging surface which defines a bottom portion of a periphery defining the engaging slot adjacent to the end edge of the engaging end portion. Each engaging end portion further includes a passage defined therein which communicates an outside of the engaging end portion with the engaging slot. The snapping member includes an enlarged snapping distal end and a slit defined in a longitudinal direction thereof, thereby separating the snapping distal end into two half pieces and allowing the two half pieces to move toward each other when passing through the passage in the associated engaging end portion. The snapping distal end includes a width greater than that of the passage and engages with the engaging surface of the engaging end portion after passing through the passage, thereby being securely yet releasably engaged with the engaging portion.

Other objects, advantages, and novel features of the invention will become more apparent from the following detailed description when taken in conjunction with the accompanying drawings.

DESCRIPTION OF THE PREFERRED EMBODIMENT

Figure 1:
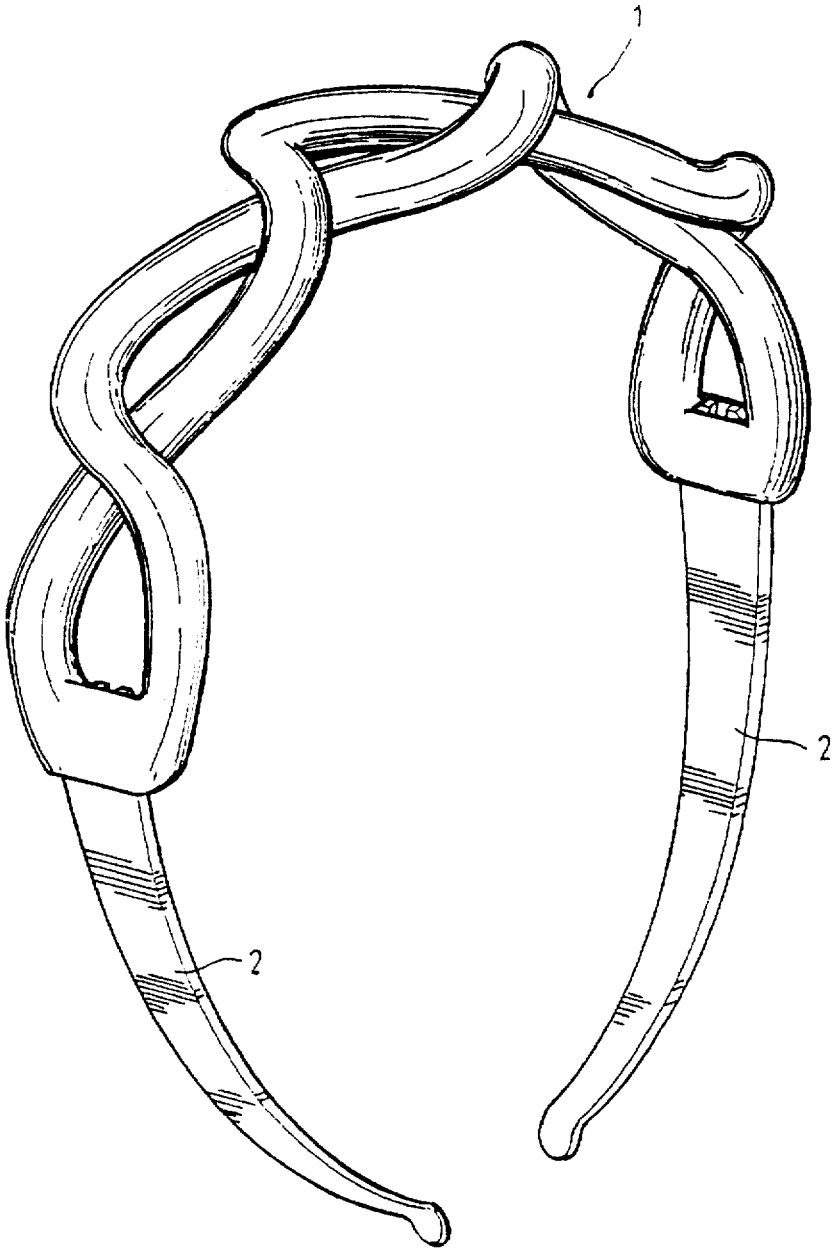
FIG. 1 is a perspective view of a hair band in accordance with the present invention.
Figure 2:
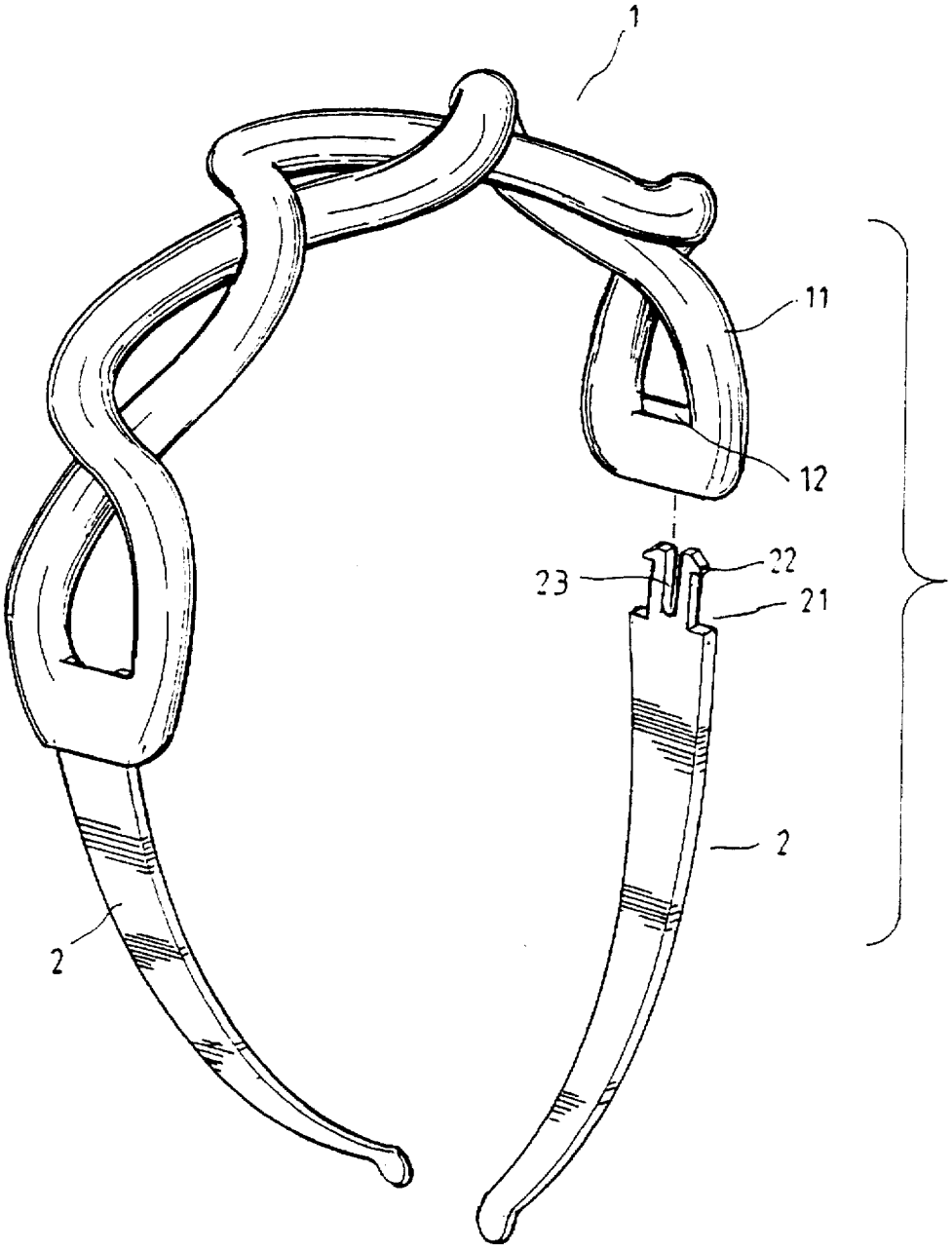
FIG. 2 is an exploded view of the hair band in accordance with the present invention.
Figure 3:
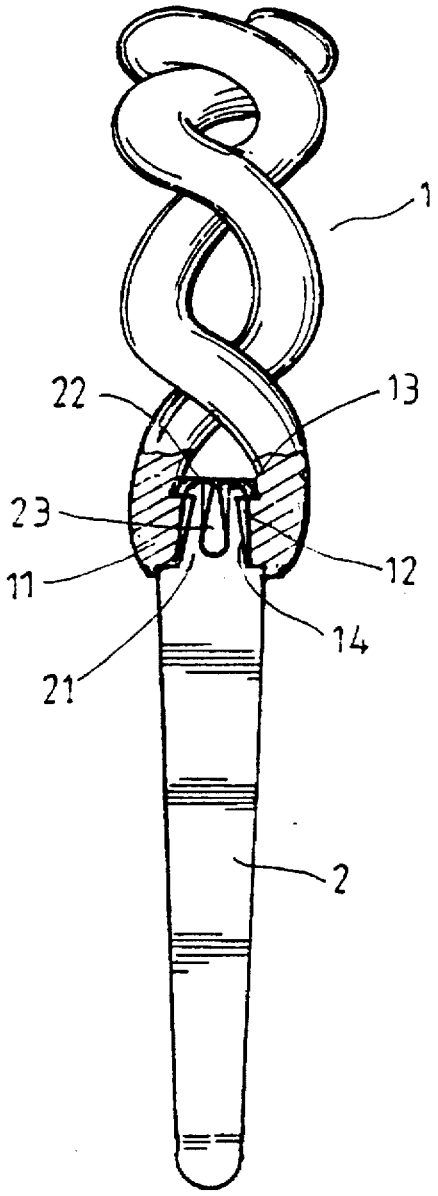
FIG. 3 is a side elevational view, partly sectioned, of the hair band in accordance with the present invention.

Referring to FIGS. 1 to 3, a hair band in accordance with the present invention generally includes a body 1 integrally formed of flexible material and two retaining pieces 2 releasably attached to two engaging end portions of the body 1, respectively. The body 1 is of a suitable curvature and has a pattern for ornamental purpose. As shown in FIG. 3, each engaging end portion 11 of the body 1 includes an engaging slot 12 defined therein and an engaging surface 13 which defines a bottom portion of a periphery defining the engaging slot 12 adjacent to an end edge of the engaging end portion 11. Each engaging end portion 11 further includes a passage 14 defined therein which communicates an outside of the engaging end portion 11 with the engaging slot 12.

Each retaining piece 2 is of a suitable curvature and includes a resilient snapping member 21 formed on one end thereof for being releasably received in the engaging slot 12 of the body 1. As shown in FIG. 2, the snapping member 21 includes an enlarged snapping distal end 22 and a slit 23 defined in a longitudinal direction thereof, thereby separating the snapping distal end 22 into two half pieces and allowing the two half pieces to move toward each other when passing through the passage 14 in the associated engaging end portion 11.

In assembly, each retaining piece 2 is releasably attached to the associated engaging end portion 11 of the body 1 by passing the snapping distal end 22 of the snapping member through the passage 14, in which the half pieces of the snapping distal end 22, after passing through the passage 14, expand to their original separated position due to resiliency and securely yet releasably engage with the engaging surface 13 of the body 1. When in the original separated position, the snapping distal end 22 has a width greater than that of the passage 14 to achieve the required securing effect.

If the user intends to use a hair band of a pattern different from that of the body 1 thereof, she may use her fingers or a suitable tool to disengage the snapping member 21 of the retaining piece 2 from the engaging slot 12 of the body. This is accomplished by pressing the half pieces of the snapping distal end 22 toward each other until a width thereof is smaller than that of the passage 14 and then pulling the retaining piece 2 away from the body 1 to remove the snapping distal end 22 from the body 1. Thereafter, the retaining pieces 2 may be attached to another body of the required pattern.

Conclusively, the hair band of the present invention has the several advantages when compared with conventional products. First, the retaining pieces 2 may cooperate with bodies 1 of different patterns according to personal habits and/or wearing. In addition, the retaining pieces 2 may also of different colors to provide various combinations. The retaining pieces 2 can be easily and securely attached to the body 1, such that when the body 1 fades, the user may change the body 1 with a new one, which may save cost more or less.

Although the invention has been explained in relation to its preferred embodiment, it is to be understood that many other possible modifications and variations can be made without departing from the spirit and scope of the invention as hereinafter claimed.

What is claimed is:

1. A hair band comprising:

a body integrally formed of flexible material and having a first curvature and two engaging end portions each with an end edge, each said engaging portion comprising an engaging slot defined therein; and a retaining piece of a second curvature and including a resilient snapping member formed on one end thereof for being releasably received in one of the engaging slots of the body;

each said engaging end portion of said body including an engaging surface which defines a bottom portion of a periphery defining the engaging slot adjacent to the end edge of the engaging end portion, each said engaging end portion further including a passage defined therein which communicates an outside of the engaging end portion with the engaging slot; and said snapping member including an enlarged snapping distal end and a slit defined in a longitudinal direction thereof, thereby separating said snapping distal end into two half pieces and allowing said two half pieces to move toward each other when passing through said passage in the associated engaging end portion, said snapping distal end including a width greater than that of said passage and engaging with said engaging surface of said engaging end portion after passing through said passage, thereby being securely yet releasably engaged with said engaging end portion.

* * * * *